US005335474A

United States Patent [19]

Rüetschi et al.

[11] Patent Number: 5,335,474

[45] Date of Patent: Aug. 9, 1994

[54] APPARATUS FOR SUPPLYING CONTAINERS TO A SEALING DEVICE

[75] Inventors: Heinz Rüetschi, Suhr; Hansrudolf Hediger, Aarau, both of Switzerland

[73] Assignee: Ferrum AG, Rupperswil, Switzerland

[21] Appl. No.: 979,618

[22] Filed: Nov. 19, 1992

[30] Foreign Application Priority Data

Nov. 27, 1991 [CH] Switzerland ..... 3469/91-4

[51] Int. Cl.[5] ..... B65B 7/28

[52] U.S. Cl. ..... 53/282; 53/308; 53/312; 53/314; 53/367

[58] Field of Search ..... 53/282, 283, 287, 300, 53/302, 314, 367, 267, 308, 312, 313; 198/418.3, 418.4, 456, 637, 690.2, 699, 733, 735.3

[56] References Cited

U.S. PATENT DOCUMENTS

| | | | |
|---|---|---|---|
| 1,571,269 | 2/1926 | Jaeger | 53/313 |
| 1,866,369 | 7/1932 | Podel | 53/313 X |
| 2,675,117 | 4/1954 | Pinsenschaum | 198/637 X |
| 2,910,167 | 10/1959 | Phin | 198/456 |
| 2,971,306 | 2/1961 | Phillips | 53/313 X |
| 3,124,916 | 3/1964 | Anderson et al. | 53/314 |
| 3,364,652 | 1/1968 | Groth et al. | 53/282 |
| 3,378,129 | 5/1968 | Mencacci | 53/282 |
| 3,442,368 | 5/1969 | Heifetz | 198/733 |
| 3,492,785 | 2/1970 | Mancini | 53/282 |
| 3,650,566 | 3/1972 | Lee et al. | 198/456 |
| 3,694,999 | 10/1972 | Switliski | 53/313 |
| 3,755,987 | 9/1973 | Dardaine et al. | 53/367 X |
| 3,768,624 | 10/1973 | Korynlak | 198/735.3 X |
| 3,778,959 | 12/1973 | Langen et al. | 198/419.3 X |
| 3,908,341 | 9/1975 | Conti | 53/314 |
| 4,109,446 | 8/1978 | Krohn et al. | 53/282 |
| 4,717,015 | 1/1988 | Waller | 198/735.3 X |
| 4,993,537 | 2/1991 | Bianchini et al. | 198/418.4 X |
| 5,012,630 | 5/1991 | Ingram et al. | 53/314 X |
| 5,014,491 | 5/1991 | Tsukada et al. | 53/282 X |
| 5,050,369 | 9/1991 | Fiwek et al. | 53/282 X |

FOREIGN PATENT DOCUMENTS

| | | | |
|---|---|---|---|
| 7808046 | 2/1980 | Netherlands | 53/314 |

*Primary Examiner*—John Sipos
*Assistant Examiner*—Daniel B. Moon
*Attorney, Agent, or Firm*—Bucknam and Archer

[57] ABSTRACT

The apparatus has a circular can filling device, a lid star wheel, a lid supply star wheel and a sealing device. The sealing device is spaced from both the filling device and the lid supply means but the path is very short. The lid star wheel and the can filling device for filling the containers or cans have a container transfer area, in which the lids are individually placed on the cans. In order to transport the cans with the lids thereon to the sealing device, a conveying unit is provided, which has two container guides, between which the containers are guided to the sealing device by the conveying unit.

8 Claims, 3 Drawing Sheets

APPARATUS FOR SUPPLYING CONTAINERS TO A SEALING DEVICE

BACKGROUND OF THE INVENTION

The present invention relates to an apparatus for filling and sealing containers.

It is well known that containers, particularly tin cans, after they are filled in filling machines must be sealed with lids or covers in a sealing or closing device. However, the problem has existed that the transportation time of the container between the exit from the filling machine and the positioning of the lid in the closing device is relatively long, so that frothing or spilling or dripping over of the liquid has occurred with resulting difficulties and quality losses.

DESCRIPTION OF THE RELATED ART

In order to obviate these disadvantages, a filling and sealing unit is known from DE-OS 25 05 355, in which the transfer of the filled bottles from the filling machine to the sealing machine takes place by means of a common rotating star wheel and above the star wheel and level with the bottle mouths in each case there is provided a sealing element, which sealingly rests on the mouths of the bottles in the star wheel. The result of this sealing of the mouths of the bottles is that the escape of foam is completely prevented, no liquid drips over and biological deterioration is prevented.

It is also known from DE-OS 14 32 416 to supply lids from a stacking mechanism to the discharge star wheel, to place the lids on the latter in the vicinity of its guidance gaps, and the cans, after being filled, receive the lids from the discharge star wheel.

SUMMARY OF THE INVENTION

The object of the present invention is to provide an improved sealing apparatus which is free of the drawback of the liquid spilling over because the lids are sealed immediately after the containers have been filled.

The crux of the present invention resides in an apparatus which comprises lid supply means and a filling device for filling purposes having a container transfer area with the lids being individually placed on the containers and the sealing device is spaced both from the filling device and from the lid supply means. The apparatus further comprises a conveying unit in order to supply the containers with the lids placed thereon to the sealing device. The filling device is separate from the sealing device but the path is very short.

BRIEF DESCRIPTION OF THE DRAWINGS

The invention is described in greater detail hereinbelow by the reference the drawings in which:

As shown in FIG. 1, the apparatus comprises a circular can filling device 1, of which only a small marginal part is diagrammatically shown due to its large diameter, a lid star wheel 2, a lid supply star wheel 3 and a sealing device 4. The can filling device and the lid star wheel 2 have a container transfer area 5 and the lid star wheel 2 and the lid supply star wheel 3 have a contact area 6. Further the sealing device 4 is at a short distance, but is completely separate from the filling device 1, from the lid star wheel 2 and the lid supply star wheel 3.

Figure 1:
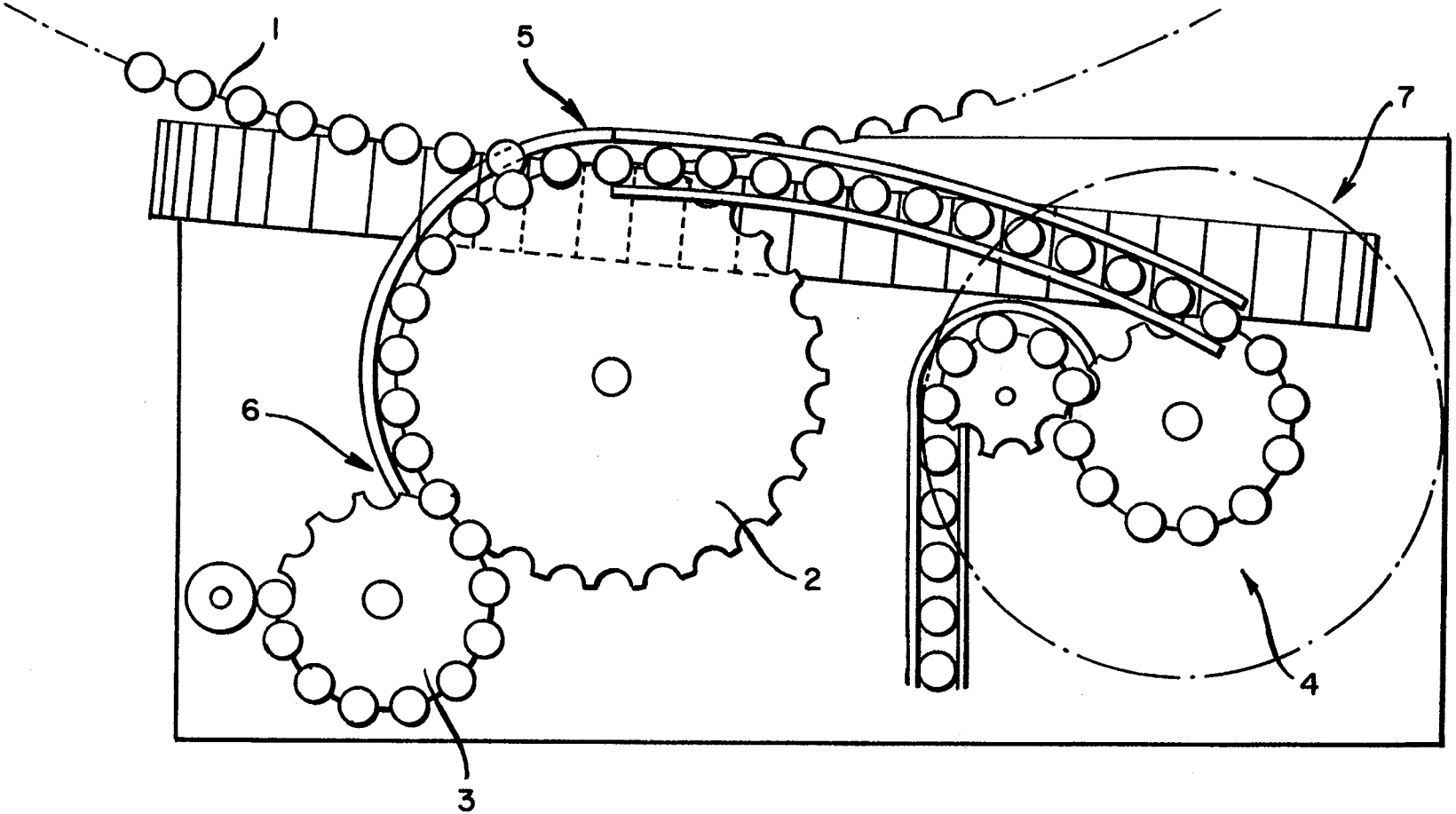
FIG. 1 is a diagrammatic plan view of an apparatus according to the invention with a filling device, a lid star wheel, a conveying unit and a sealing device.
Figure 2:
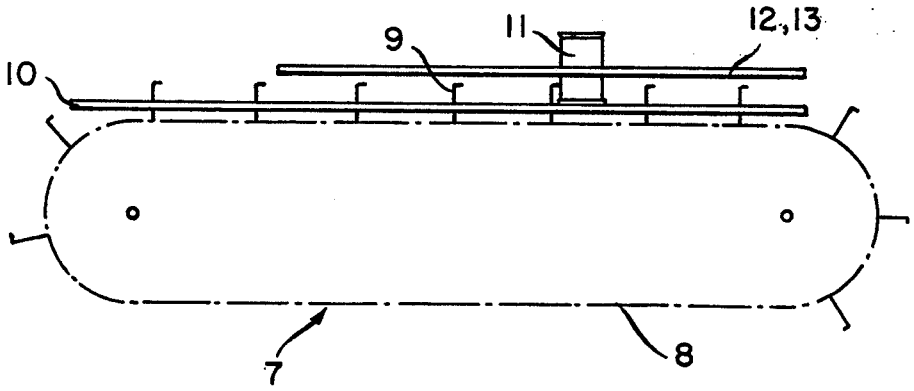
FIG. 2 is a diagrammatic side view of the conveying unit of the apparatus of FIG. 1.
Figure 3:
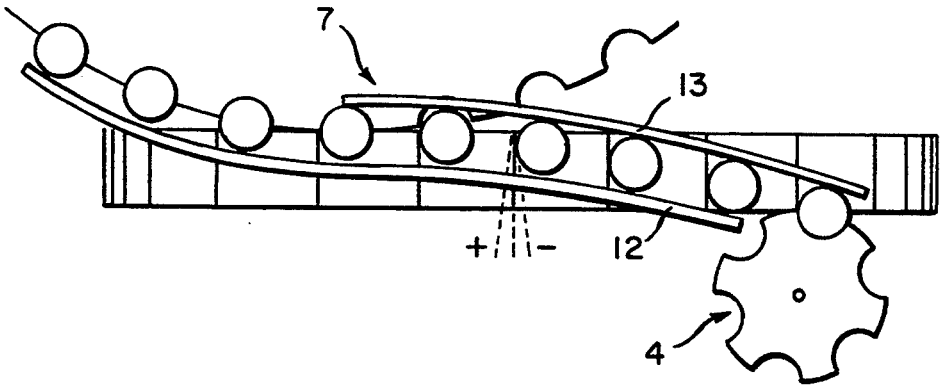
FIG. 3 is a diagrammatic plan view of the conveying unit of the apparatus of FIG. 1.

The conveying unit 7 shown in FIGS. 2 and 3 constitutes a connection between the container transfer area 5 and the sealing device 4. It comprises a conveyor 8, e.g. a belt or chain conveyor, which is provided with spaced drivers 9. In the embodiment according to FIG. 2 and at a limited distance from the conveying path is provided a fixed, smooth container support 10, on which the containers or cans 11 are allowed to slide under the action of the drivers 9, with the containers 11 being guided by two parallel, spar-like container guides 12, 13.

In the embodiment shown in FIG. 3 the conveyor belt of the conveyor 8 serves as a movable container support. In FIG. 3 the container guides 12 and 13 are diagrammatically shown in plan view, with the sealing device 4 being disposed at one end region of the conveying unit 7. The symbols + and − indicate that the drivers 9 can be set in a straight or sloping manner in order to compensate the speed differences between the filling device 1 and the sealing device 4.

Figure 4:
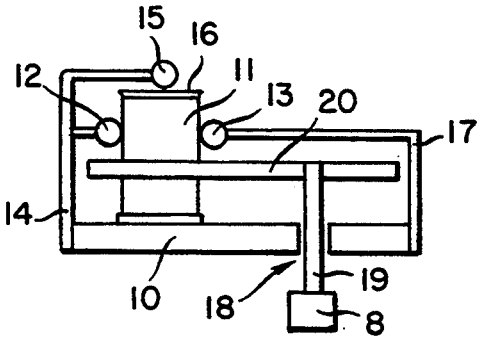
FIGS. 4 & 5 illustrate two diagrammatic embodiments of the conveying unit.

FIG. 4 shows a can 11, which is guided between the two guides 12 and 13. The guide 12 is connected by means of fastenings 14 to one side and the guide 13 by means of fastenings 17 to the other side of the fixed container support 10. The fastenings 14 have widened portions, which carry a further, upper guide 15 and ensure that the lids 16 cannot fly off as a result of the vibration due to gas pressure. For this purpose, the smallest distance between the guide 15 and the top of the lid 16 is smaller than the height of the lid at its edges. The fixed container support 10 has an elongated, slot-like passage opening 18, into which is inserted a web 19, which transfers the movement from the conveyor 8 to the arm 20 of the driver 9 shown in FIG. 2.

Figure 5:
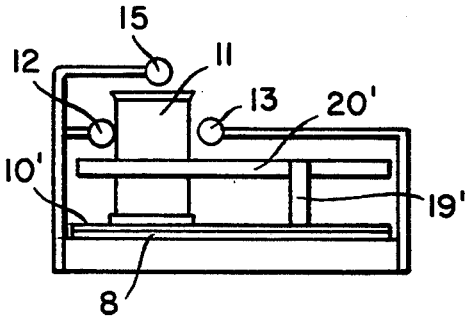

FIG. 5 also shows a can 11, which is guided between the two guides 12 and 13. However, differently from the construction shown in FIG. 4, in this case there is no fixed container support, because the web 19′ is directly connected to the conveyor belt 10′ of the conveyor 8.

Figure 6:
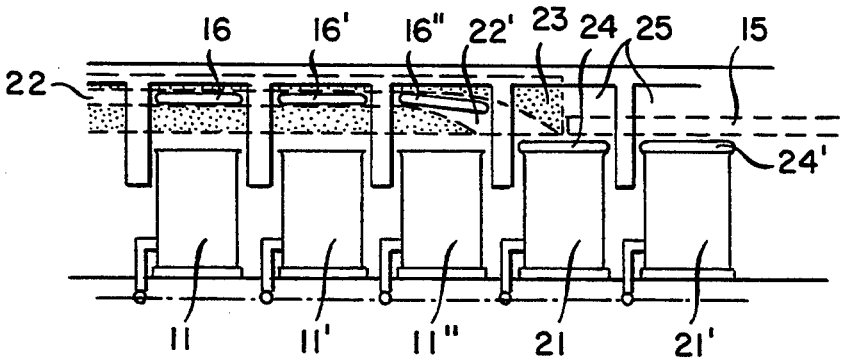
FIG. 6 illustrates the operation of a curved lid guide located in the vicinity of the filling device.

FIG. 6 shows three cans 11, 11′, 11″ transported from the filling device 1 in the container transfer area 5, three lids 16, 16′, 16″ conveyed on a lid guide 23 in a slot 22. Can 21 has a lid 24 on top, the can having just been transferred from the filling device 1 to the conveying unit 7. Can 21′ has lid 24′ on top, the can having already partly released from the filling device 1 and moving between the container guides 12 and 13. In the area above the cans 11″ and 21 the slot 22 is widened downwardly in such a way that the lid 16″ held laterally on its edge can slide down along the widened part 22′ of the slot 22 onto the can 21.

Figure 7:
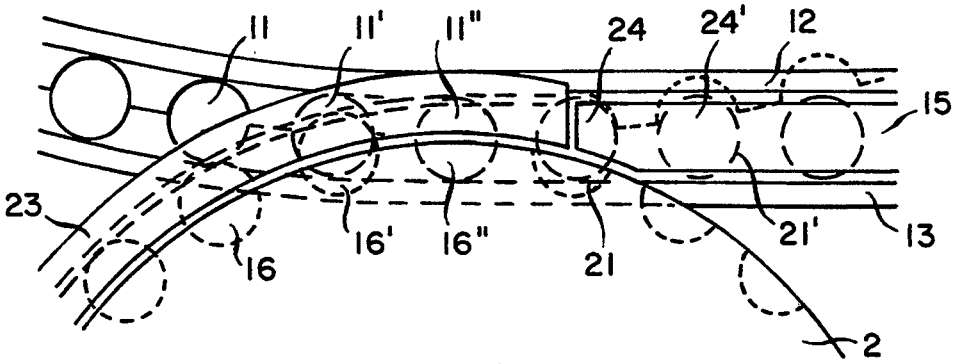
FIG. 7 is a diagrammatic plan view of the filling device, the lid star wheel and the conveying unit in the vicinity of the lid guide.

FIG. 7, shows the lid guide 23 having an arcuate shape with an inner radius, which roughly corresponds to the outer radius of the lid star wheel 2 in the vicinity of the container transfer area 5. The lid star wheel 2 is provided with recesses 25 shown in FIGS. 6 and 8 adapted to the can shape and which are sufficiently high so that in the upper area the lids can be housed at a limited distance above the cans.

Figure 8:
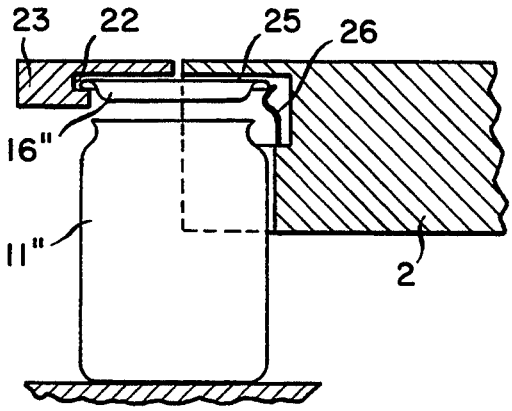
FIG. 8 is a side view of the container, the lid of which is lust located in the lid guide.

FIG. 8 shows that the difference between the outer and the inner radius of the arcuate lid guide 23 is larger than the radius of the lid and the height of the slot 22 exceeds the thickness of the lid 16" at its edge. The lid 16" is consequently inserted into the slot 22 at the left-hand side. At the right-hand side the lid 16" is retained by a retaining spring 26, which is designed in such a way that if it yields, the lid 16" can be led downwardly onto the can 11' from the right-hand side.

The apparatus according to FIGS. 1 to 8 functions as follows. In the lid star wheel 2, which is continuously supplied with lids by the lid supply star wheel 3, the lids are brought into a horizontal position somewhat above the incoming, already filled cans 11. The lid star wheel 2 can be replaced by a random type of lid supply means. In the upper area of the lid chamber 25 (FIG. 8) a retaining spring 26 is provided so that the lids 16, 16', 16" are held laterally in the lid guide 23 on one side by the slot 22 and on the other side by the retaining springs 26. In the container transfer area 5, where the widened portion 22' of the slot 22 is located, the lid 16" is not held and is moved laterally downwardly onto the can 11". At this time the other side of the lid 16" slides down from the retaining spring 26, which yields outwardly until the lid 16" is positioned horizontally on the can 11". At this time the transfer of the can 11" with the lid 16" to the conveying unit 7 takes place. As shown in FIGS. 4 or 5, the can and lid are held by the guides 12, 13 and 15 until they reach the sealing device 4, where sealing takes place.

A substantial advantage of the apparatus according to the invention is that as a result of the conveying unit 7 the filling device 1 is located remote from the sealing device 4 but the path of the can between the filling device 1 and the sealing device 4 is extremely short and it would also be possible for the installation to have a modular construction.

Still another advantage is that due to the lid guide 23 the cans are provided with a lid immediately after being filled in the filling device 1 and with the conveying unit 7 a spilling out or over of the can content is prevented. This also prevents any foreign substances from entering the containers.

What is claimed is:

1. An apparatus for supplying lids to containers filled by a filling device and transporting said containers with lids thereon to a sealing device for closing said containers with said lids, comprising:

a) a lid supply means (2) arranged in juxtaposition to said filling device (1) at a transfer area (5) for said containers whereby lids are placed on said containers, said lid supply means being a star wheel having an outer radius;

b) an outer, arcuate lid guide (23) for guiding the lids (16") from said star wheel into position for covering the containers (11"), said lid guide having an inner radius corresponding approximately to said outer radius of said star wheel at said container transfer area (5), said lid guide having an inner area and said inner area having a slot (22) on a side of the path of said lids;

the star wheel of said lid supply means having retaining springs (26) located in a perimeter of said star wheel on the side of the lid path opposite to said slot (22) in said lid guide so as to laterally retain said lids;

said slot (22) having a downwardly widened portion (22') at said container transfer area whereby the lids slide along said widened area onto the containers;

c) a conveying unit (7) for conveying said containers (11) having lids placed thereon from said container transfer area to said sealing device (4), said conveying unit including:

A) a conveyor means (8),

B) a support (10) for said containers having a slot (18) therein, said support being arranged above said conveyor means, C) two container guides (12,13) for guiding said containers to said sealing device, and D) drivers (9) for driving said containers, each driver including an arm (20) for engaging a container and a web (19) connecting said arm to said conveyor means through the slot in said support;

said sealing device being spaced from both said filling device and said lid supply means.

2. The apparatus according to claim 1 wherein said support is fixedly arranged between said container transfer area and said sealing device.

3. The apparatus according to claim 2 wherein said drivers (9) cause said containers to slide on said support (10).

4. The apparatus according to claim 1 wherein said container guides (12,13) are disposed respectively on each side of said containers and said conveying unit (7) includes a third guide (15) located above said lids for positioning said lids on the containers.

5. The apparatus according to claim 4 wherein each of said lids has a given height at the edge thereof and said third guide (15) is placed at a distance above said lids, said distance being smaller than the height of the lids at the edges thereof.

6. The apparatus according to claim 1 wherein said star wheel has recesses (25) of shade corresponding to the shape of said containers and each adapted to retain a lid therein, each recess having a height permitting retention of a lid therein at short distance above said containers.

7. The apparatus according to claim 1, wherein said support (10) comprises a fixed horizontal plane surface arranged between said container transfer area (5) and said sealing device (4).

8. An apparatus for supplying lids to metallic or plastic containers filled by a filling device and transporting said containers with lids thereon to a sealing device for sealing the lids onto said containers, comprising:

a) a lid supply means (2) arranged in juxtaposition to said filling device (1) at a transfer area (5) for said containers whereby lids are placed on said containers, said lid supply means being a star wheel having an outer radius;

b) an outer, arcuate lid guide (23) for guiding the lids (16") from said star wheel into position for covering the containers (11"), said lid guide having an inner radius corresponding approximately to said outer radius of said star wheel at said container transfer area (5), said lid guide having an inner area and said inner area having a slot (22) on a side of the path of said lids;

the star wheel of said lid supply means having retaining springs (26) located in a perimeter of said star wheel on the side of the lid path opposite to said slot (22) in said lid guide so as to laterally retain said lids;

said slot (22) having a downwardly widened portion (22') at said container transfer area whereby the lids slide along said widened area onto the containers;

c) a conveying unit (7) for conveying said containers (11) having lids placed thereon from said container transfer area to said sealing device (4), said conveying unit including:

A) two container guides (12,13) for guiding said containers to said sealing device, B) drivers (9) for driving said containers, each driver including an arm (20) for engaging a container, and C) a movable support for supportingly moving said containers in conjunction with said drivers between said container transfer area and sealing device, said movable support comprising a horizontal plane surface defined by a top stringer of a conveyor belt;

said sealing device being spaced from both said filling device and said lid supply means.

* * * * *